US012600008B2

(12) United States Patent
Kwon et al.

(10) Patent No.: US 12,600,008 B2
(45) Date of Patent: Apr. 14, 2026

(54) SUBSTRATE POLISHING APPARATUS AND METHOD OF POLISHING SUBSTRATE USING THE SAME

(71) Applicant: Samsung Electronics Co., Ltd., Suwon-si (KR)

(72) Inventors: Donghoon Kwon, Suwon-si (KR); Boun Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 439 days.

(21) Appl. No.: 18/210,107

(22) Filed: Jun. 15, 2023

(65) Prior Publication Data

US 2023/0415304 A1 Dec. 28, 2023

(30) Foreign Application Priority Data

Jun. 27, 2022 (KR) ..... 10-2022-0078207

(51) Int. Cl.
*B24B 53/017* (2012.01)

(52) U.S. Cl.
CPC ..... *B24B 53/017* (2013.01)

(58) Field of Classification Search
CPC ..... B24B 53/00; B24B 53/017; B24B 57/00; B24B 57/02; B24B 37/00; B24B 37/04; B24B 37/042
See application file for complete search history.

(56) References Cited

U.S. PATENT DOCUMENTS

| | | | | |
|---|---|---|---|---|
| 8,845,398 | B2 | 9/2014 | Chen | |
| 2004/0072518 | A1 | 4/2004 | Prabhu et al. | |
| 2006/0286906 | A1 | 12/2006 | Myers et al. | |
| 2015/0065020 | A1 | 3/2015 | Roy et al. | |
| 2015/0126095 | A1 | 5/2015 | Chen et al. | |
| 2019/0283208 | A1* | 9/2019 | Dhandapani | B24B 49/105 |
| 2019/0299357 | A1 | 10/2019 | Orilall et al. | |
| 2022/0234165 | A1* | 7/2022 | Ho | B24B 37/20 |

FOREIGN PATENT DOCUMENTS

| | | | | |
|---|---|---|---|---|
| TW | I737928 B | * | 9/2021 | H01L 21/304 |
| WO | 2019139586 A1 | | 7/2019 | |

* cited by examiner

*Primary Examiner* — C. A. Rivera
(74) *Attorney, Agent, or Firm* — Muir Patent Law, PLLC

(57) ABSTRACT

A substrate polishing apparatus includes a polishing pad including a magnetic material, a platen having an upper surface to which the polishing pad is attached, a slurry supply unit installed on the polishing pad, a conditioner installed on the polishing pad to be spaced apart from the slurry supply unit in the one direction and configured to fine-polish a surface of the polishing pad, a polishing head installed on the polishing pad to be spaced apart from the conditioner in the one direction and configured to rotate a polishing target, and a magnetic module installed on the polishing pad to be disposed between the conditioner and the polishing head in the one direction and configured to apply magnetic force to polishing pad debris to remove the polishing pad debris.

20 Claims, 7 Drawing Sheets

SUBSTRATE POLISHING APPARATUS AND METHOD OF POLISHING SUBSTRATE USING THE SAME

CROSS-REFERENCE TO RELATED APPLICATION(S)

This application claims benefit of priority under 35 U.S.C. § 119 to Korean Patent Application No. 10-2022-0078207, filed on Jun. 27, 2022, in the Korean Intellectual Property Office, the disclosure of which is incorporated herein by reference in its entirety.

BACKGROUND

The present disclosure relates to a substrate polishing apparatus and a method of polishing a substrate using the same.

A chemical mechanical polishing (CMP) process is a process of planarizing a surface of a substrate by combining a mechanical polishing effect using an abrasive with a chemical reaction effect using an acid or a base solution.

Such a CMP process is used to planarize various types of material in a process of polishing a silicon oxide layer for the purpose of forming an interlayer dielectric (ILD) or a shallow trench isolation (STI) structure, a tungsten (W) plug formation process, a copper (Cu) wiring process, and the like.

A conditioning process of fine-polishing a surface of a polishing pad with a conditioner is performed to achieve uniform polishing conditions of a CMP process, but polishing pad debris generated in the conditioning process may be introduced to a polishing head.

SUMMARY

Example embodiments provide a substrate polishing apparatus and a method of polishing a substrate, capable of readily removing polishing pad debris generated by a conditioner.

According to an example embodiment, a substrate polishing apparatus includes: a polishing pad including a magnetic material; a platen having an upper surface to which the polishing pad is attached and installed to be rotatable in one direction; a slurry supply unit installed on the polishing pad and configured to supply slurry to the polishing pad; a conditioner installed on the polishing pad to be spaced apart from the slurry supply unit in the one direction and configured to fine-polish a surface of the polishing pad; a polishing head installed on the polishing pad to be spaced apart from the conditioner in the one direction and configured to adhere a semiconductor substrate to the polishing pad and to rotate the adhered semiconductor substrate; and a magnetic module installed on the polishing pad to be disposed between the conditioner and the polishing head in the one direction and configured to apply magnetic force to polishing pad debris, generated on the surface of the polishing pad while the surface of the polishing pad is fine-polished, to remove the polishing pad debris.

According to an example embodiment, a substrate polishing apparatus includes: a platen having an upper surface, to which a polishing pad including a magnetic material is attached, and installed to be rotatable in one direction; a conditioner installed on the polishing pad and configured to modify surface roughness of the polishing pad; a magnetic module installed on the polishing pad to be spaced apart from the conditioner in the one direction and including an electromagnet applying magnetic force to polishing pad debris generated on the surface of the polishing pad while the surface of the polishing pad is fine-polished; a power supply device configured to supply power for generating the magnetic force to the electromagnet of the magnetic module, on the polishing pad; and a control unit configured to control the power supply device to control an operation of the magnetic module.

According to an example embodiment, a substrate polishing apparatus includes: a polishing pad including a magnetic material; a platen having a surface, to which a polishing pad including a magnetic material is attached, and installed to be rotatable in one direction; a conditioner installed on the polishing pad and configured to condition a surface of the polishing pad; and a magnetic module installed on the polishing pad to be spaced apart from the conditioner in the one direction and configured to apply attractive force generated by a magnetic field to polishing pad debris, generated on the surface of the polishing pad while the conditioner conditions the surface of the polishing pad, to remove the polishing pad debris from the surface of the polishing pad.

According to an example embodiment, a method of polishing a substrate includes: disposing a semiconductor substrate on a platen having an upper surface to which a polishing pad including a magnetic material is attached; contacting the semiconductor substrate with an upper portion of the polishing pad while rotating the platen in one direction; supplying slurry to the polishing pad and rotating a polishing head to polish the semiconductor substrate; conditioning a surface of the polishing pad by contacting a conditioner with an upper portion of the polishing pad; and applying attractive force to a magnetic field of polishing pad debris, generated on the surface of the polishing pad in the operation of conditioning, using a magnetic module disposed to be spaced apart from the conditioner in the one direction to remove the polishing pad debris from the surface of the polishing pad.

BRIEF DESCRIPTION OF DRAWINGS

The above and other aspects, features, and advantages of the present disclosure will be more clearly understood from the following detailed description, taken in conjunction with the accompanying drawings in which like numbers refer to like elements throughout. In the drawings.

DETAILED DESCRIPTION

Hereinafter, example embodiments will be described with reference to the accompanying drawings.

Figure 1:
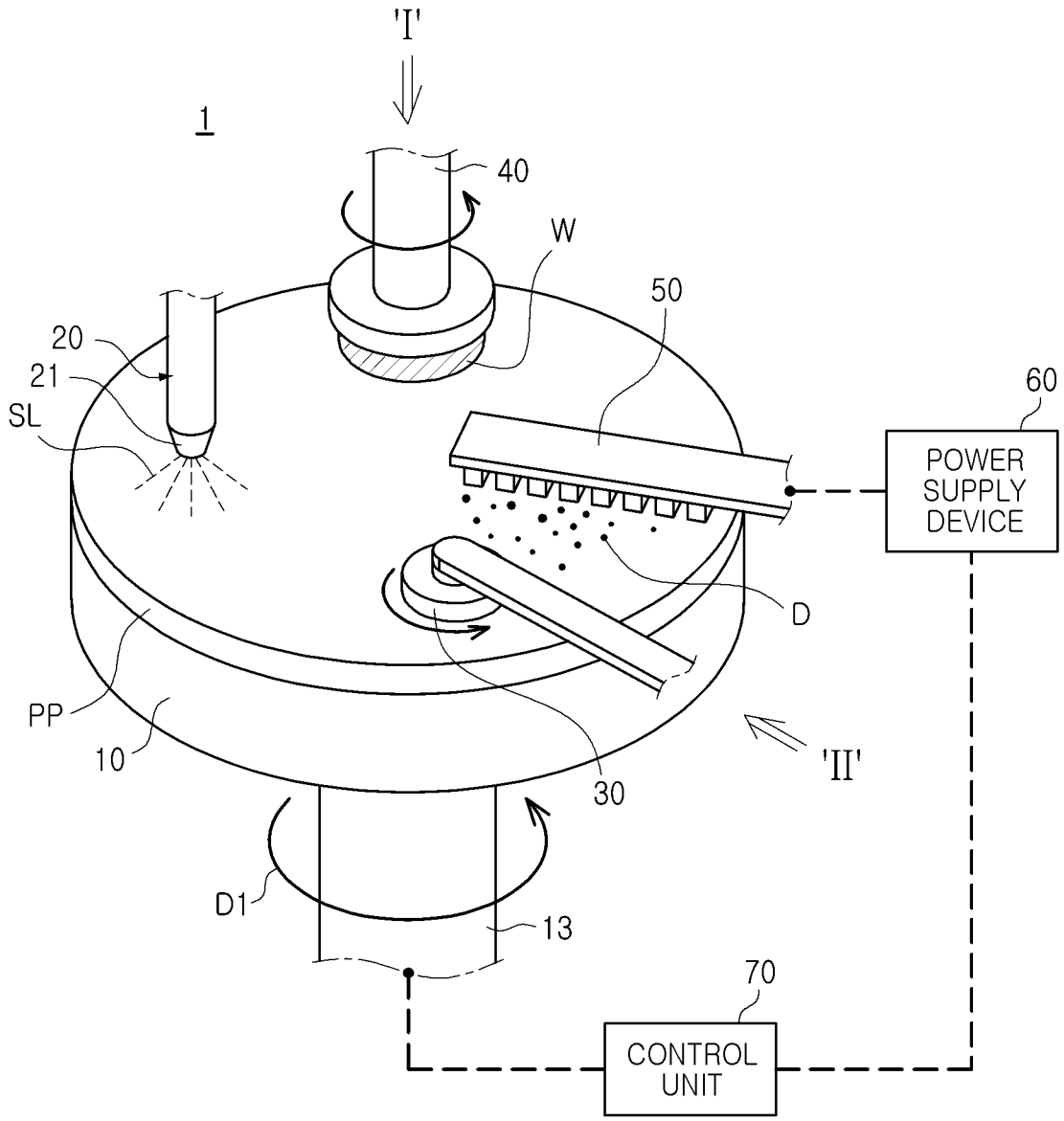
FIG. 1 is a schematic perspective view of a substrate polishing apparatus according to an example embodiment.
Figure 2:
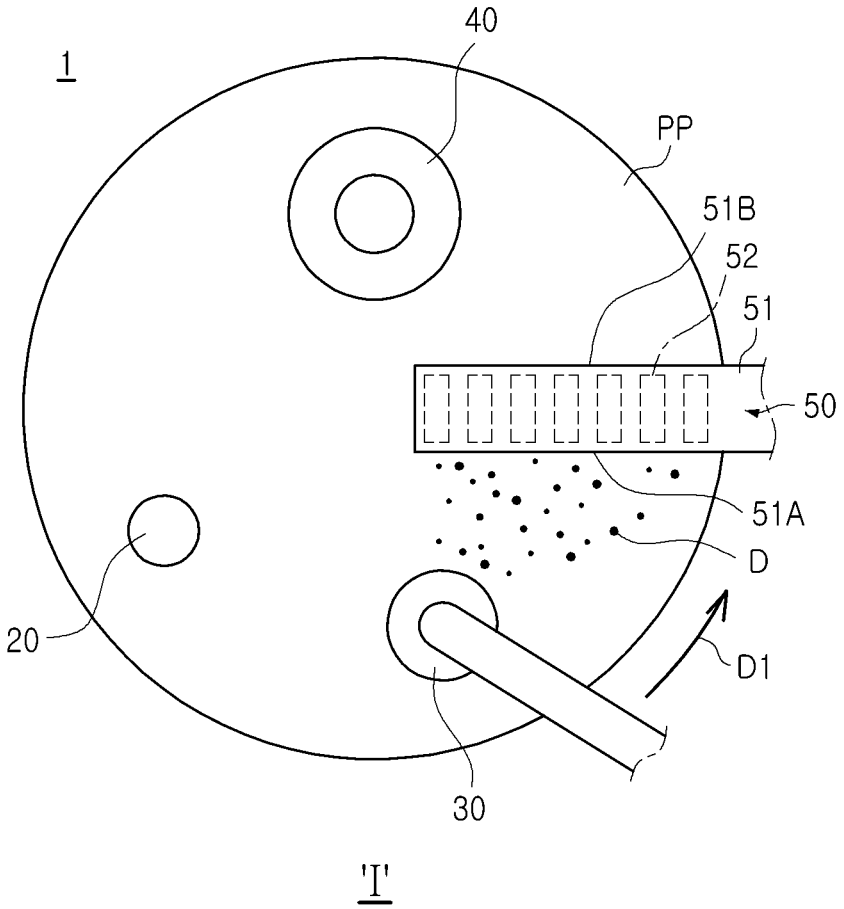
FIG. 2 is a plan view when viewed in a direction I of FIG. 1.
Figure 3:
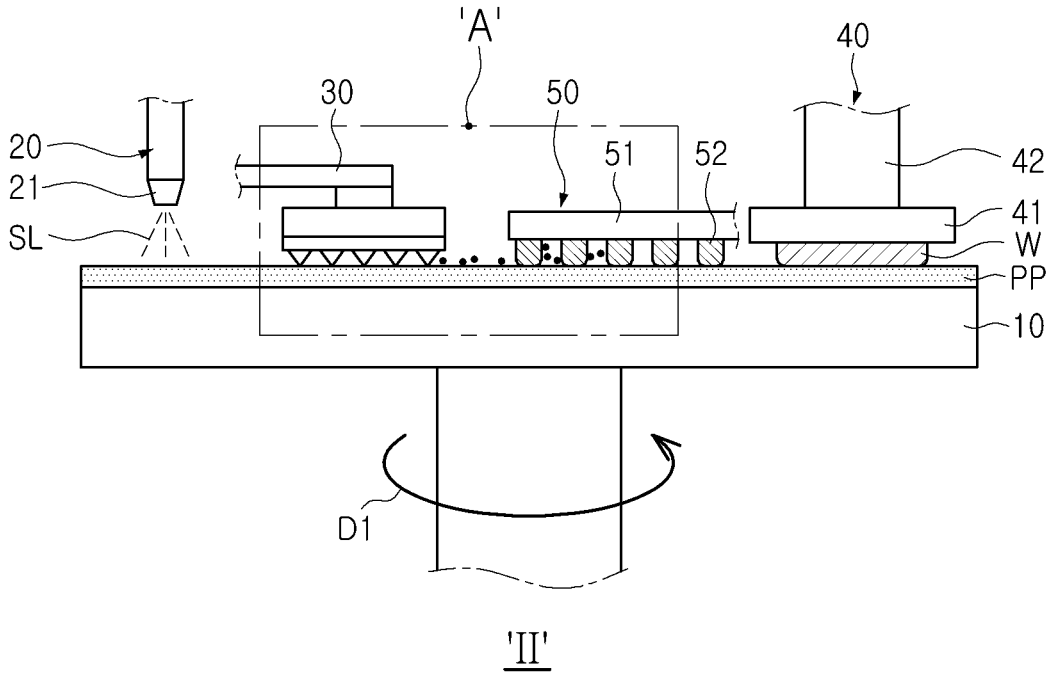
FIG. 3 is a side view when viewed in a direction II of FIG. 1.

FIG. 1 is a schematic perspective view of a substrate polishing apparatus according to an example embodiment. FIG. 2 is a plan view when viewed in a direction I of FIG. 1, and FIG. 3 is a side view when viewed in a direction II of FIG. 1.

Referring to FIGS. 1 and 2, a substrate polishing apparatus 1 may include a platen 10, a slurry supply unit 20, a conditioner 30, a magnetic module 50, and a polishing head 40. The slurry supply unit 20, the conditioner 30, the magnetic module 50, and the polishing head 40 may be sequentially disposed in one direction D1, a direction in which the platen 10 is rotated. The substrate polishing apparatus 1 may be controlled by a control unit 70. The substrate polishing apparatus 1 according to an embodiment may be used in a process of chemically and mechanically polishing a semiconductor substrate W such as a wafer.

The platen 10 may have a disk shape and a polishing pad PP, providing a place in which the semiconductor substrate W is chemically and mechanically polished, may be attached to an upper surface of the platen 10. In addition, the platen 10 may be rotated in the one direction D1 by connecting a rotation shaft 13 to a lower surface of the platen. The platen 10 may be rotated clockwise or counterclockwise about a rotation shaft 13. In an example embodiment, a case in which the platen 10 is rotated counterclockwise will be described as an example.

The polishing pad PP may have a disk shape, and a lower surface of the polishing pad PP may be attached to the upper surface of the platen 10. An upper surface of the polishing pad PP may be provided as a polishing surface to polish the semiconductor substrate W. The polishing pad PP may include a magnetic material.

Accordingly, the polishing pad PP may be attracted by magnetic force. For example, the polishing pad PP may be formed of a magnetic polymer material. In addition, the polishing pad PP may be formed of a material in which a magnetic polymer material PP2 is mixed with a synthetic resin material PP1 such as polyurethane (see FIG. 4). For example, the magnetic polymer may include the polymer PANiCNQ, a combination of emeraldine-based polyaniline (PANi) and tetracyanoquinodimethane (TCNQ). In addition, the polishing pad PP may be formed of a material in which magnetic particles are mixed with a synthetic resin material such as polyurethane. For example, the magnetic particles include Fe, Ni, Co, Gd, Dy, or alloys thereof, as well as ferromagnetic particles such as $Fe_2O_3$, $CoFe_2O_4$, $FeOFe_2O_3$, $NiOFe_2O_3$, $CuOFe_2O_3$, $MgOFe_2O_3$, MnBi, MnSb, $MnOFe_2O_3$, $Y_3Fe_5O_{12}$, $CrO_2$, MnAs, or EuO. Alternatively, the polishing pad PP may be formed of a material in which magnetic particles are mixed with a magnetic polymer material.

The slurry supply unit 20 may be disposed on the polishing pad PP to be spaced apart from the polishing head 40 in the one direction D1. Also, the slurry supply unit 20 may be spaced apart from a front end of the conditioner 30 in the one direction D1. The slurry supply unit 20 may include at least one nozzle 21, and may inject slurry SL onto a surface of the polishing pad PP through the nozzle 21. The slurry SL, injected from the slurry supply unit 20, may be used to polish a surface of the semiconductor substrate W in the polishing head 40, and may then be discharged to the outside of the platen 10. According to example embodiments, the slurry supply unit 20 may inject the slurry SL in a state in which the slurry SL is heated or cooled. The slurry SL, supplied from the slurry supply unit 20, may react with the surface of the semiconductor substrate W, attached to the polishing head 40, to be used to perform a chemical mechanical polishing process.

Figure 4:
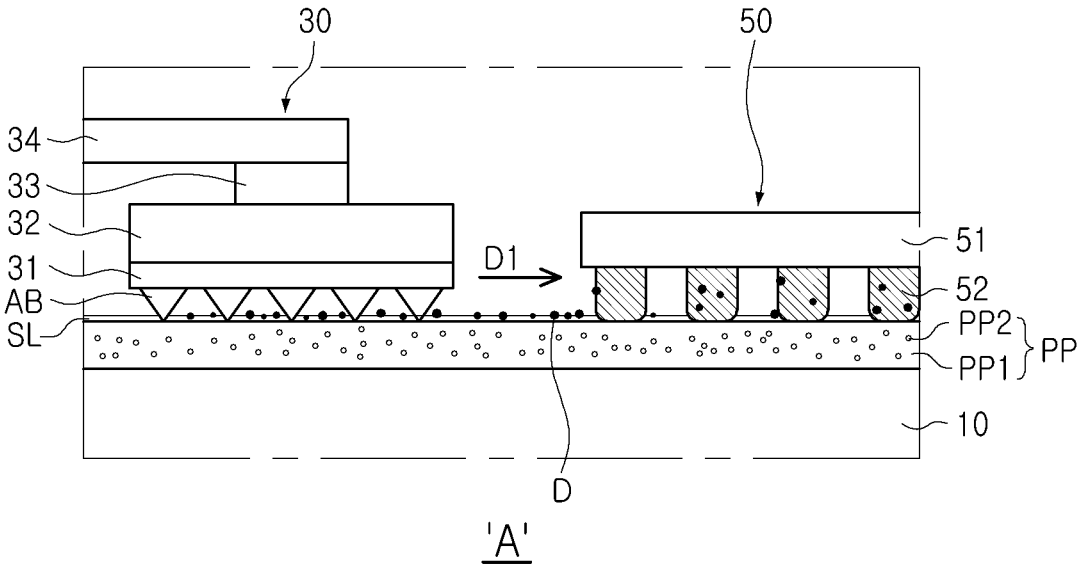
FIG. 4 is an enlarged view of portion "A" of FIG. 3.

Referring to FIGS. 2 and 3, the conditioner 30 may be disposed on the polishing pad PP to be spaced apart from the slurry supply unit 20 in the one direction D1. Also, the conditioner 30 may be disposed between the slurry supply unit 20 and the polishing head 40 in the one direction D1. To modify surface roughness of the polishing pad PP, the conditioner 30 may perform a conditioning process to fine-polish the surface of the polishing pad PP with a conditioning disk 31 to which an abrasive AB, such as diamond particles, is attached. The conditioning process may be periodically performed to achieve uniform surface roughness of the polishing pad PP. Referring to FIG. 4, the conditioner 30 may include the conditioning disk 31 and a disk holder 32 for supporting the conditioning disk 31. As an upper portion of the disk holder 32 is connected to the rotation shaft 33, the disk holder 32 may be rotated by a driving device such as a motor. An arm 34 may be disposed on one end of the rotation shaft 33 to reciprocate the conditioning disk 31 in both left and right directions.

During the process of fine-polishing the upper surface of the polishing pad PP using the conditioner 30, polishing pad debris D, generated during fine-polishing of the polishing pad PP, may remain on the surface of the polishing pad PP. Due to the rotation of the polishing pad PP, the polishing pad debris D may be introduced to the polishing head 40 together with the slurry SL. Since the polishing pad debris D has a size ranging from several hundreds of nanometers (nm) to several micrometers (μm), the surface of the semiconductor substrate W may be scratched when the polishing pad debris D is introduced to the polishing head 40. When the conditioner 30 reduces force applied to press the polishing pad PP to decrease the polishing pad debris D, it may be difficult to uniformly maintain the surface state of the polishing pad PP. Since the polishing pad PP according to example embodiments includes a magnetic material, the polishing pad debris D generated during fine-polishing of the polishing pad PP may also become magnetic. Accordingly, the polishing pad debris D may be removed using the magnetic force of the magnetic module 50. This will be described later.

The magnetic module 50 may be disposed on a rear end of the conditioner 30, for example, between the conditioner 30 and the polishing head 40 in the one direction D1. The magnetic module 50 may recover the polishing pad debris D, remaining in the polishing pad PP, using magnetic force. In example embodiments, the magnetic module 50 may be moved above the polishing pad PP or moved to an external side of the polishing pad PP by a driving device such as a motor.

Referring to FIGS. 2 and 3, the magnetic module 50 may include a body portion 51 and a magnetic portion 52. The body portion 51 may be a support for disposing the magnetic portion 52, and may be omitted according to example embodiments. The body portion 51 may be formed to have an elongated bar shape or a disk shape in a length direction. However, example embodiments are not limited thereto, the body portion 51 may be formed to have various shapes as long as the magnetic portion 52 may be disposed therein. The body portion 51 may be moved or rotated by a driving device such as a motor.

The magnetic portion 52 may apply attractive force to a magnetic field of the polishing pad debris D such that the polishing pad debris D including a magnetic material is attached to the magnetic module 50. The magnetic portion 52 may be disposed on a lower surface of the body portion 51 to contact the upper surface of the polishing pad PP. A lower surface of the magnetic portion 52 may be rounded to significantly reduce friction with the upper surface of the polishing pad PP.

The shape of the magnetic portion 52 may be widely varied. FIGS. 5A to 5D are views, illustrating various modified examples of a magnetic portion (e.g., magnetic portions 52A, 52B, 52C, and 52D), when viewed from the top of the magnetic module 50.

Figure 5A:
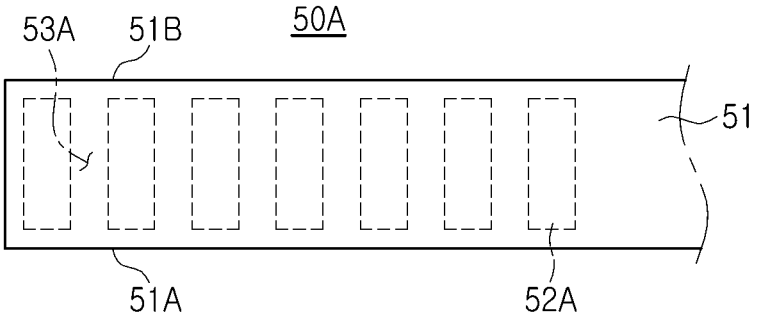
FIGS. 5A to 5D are views illustrating various modified examples of a magnetic portion.

Referring to FIG. 5A, a magnetic module 50A may include a body portion 51 and a plurality of magnetic portions 52A. The plurality of magnetic portions 52A may be arranged at predetermined intervals in a length direction of the body portion 51. The plurality of magnetic portions 52A may be arranged to have separation spaces 53A. The separation space 53A may formed to connect opposite side surfaces 51A and 51B of the body portion 51 in a width direction to each other, and may be used as a flow path through which slurry SL flows. The plurality of magnetic portions 52A may be arranged to be perpendicular to the opposite side surfaces 51A and 51B of the body portion 51.

Figure 5B:
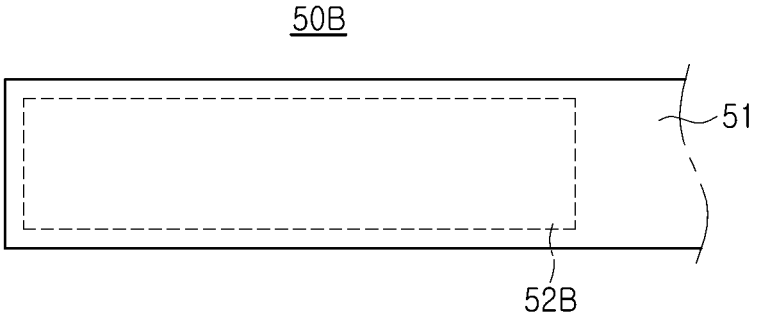

Referring to FIG. 5B, a magnetic module 50B may include a body portion 51 and a single magnetic portion 52B.

Figure 5C:
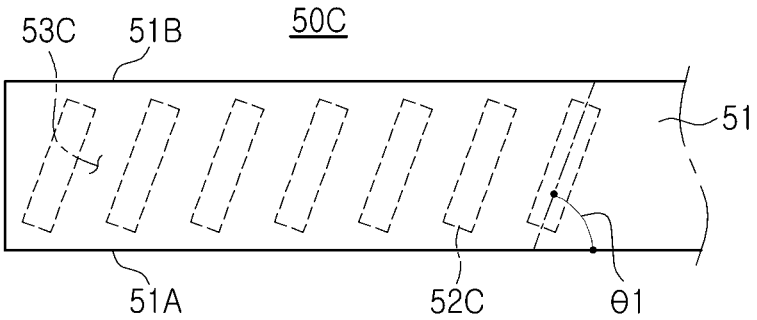

Referring to FIG. 5C, a magnetic module 50C may include a body portion 51 and a plurality of magnetic portions 52C. The plurality of magnetic portions 52C may be arranged at predetermined intervals in a length direction of the body portion 51. The plurality of magnetic portions 52C may be arranged to have separation spaces 53C. Each of the plurality of magnetic portions 52C may be disposed to be oblique at a predetermined angle θ1 with respect to one side 51A of the body portion 51.

Figure 5D:
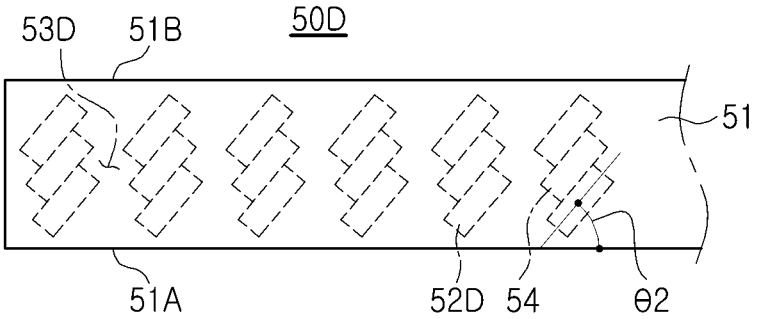

Referring to FIG. 5D, a magnetic module 50D may include a body portion 51 and a plurality of magnetic portions 52D. The plurality of magnetic portions 52D may be arranged at predetermined intervals in a length direction of the body portion 51. The plurality of magnetic portion 52D may be arranged to have separation spaces 53D arranged in the length direction and extending in the width direction. In addition, the plurality of magnetic portions 52D may be arranged in a width direction of the body portion 51. In example embodiments, the plurality of magnetic portions 52D arranged in the width direction may not be spaced apart from one another. A plurality of unit magnetic materials 54 may be disposed to overlap the plurality of magnetic portions 52D in staircase form, respectively. Each of the plurality of unit magnetic materials 54 may be arranged to oblique at a predetermined angle θ2 with respect to one side 51A of the body portion 51.

The magnetic portion 52 (e.g., magnetic portions 52A, 52B, 52C, and 52D) may include at least one of a permanent magnet and an electromagnet. A magnet may include a permanent magnet or an electromagnet. In an example embodiment, a case in which the magnetic portion 52 is an electromagnet will be described as an example.

When the magnetic portion 52 is a permanent magnet, the permanent magnet may be, for example, a neodymium magnet. When the magnetic portion 52 is an electromagnet, a power supply device 60 for applying power to the magnetic portion 52 may be connected to the magnetic module 50. In addition, the power supply device 60 may be controlled by the control unit 70 to turn on or off the power supplied to the magnetic portion 52. Accordingly, the control unit 70 may selectively supply power to the magnetic module 50 only when the magnetic force of the magnetic module 50 is required. In addition, in the case in which magnetic force is not required, such as in the case in which the magnetic module 50 is cleaned, the power may be cut off.

Referring to FIG. 4, the above-configured magnetic module 50 may apply magnetic force to the upper surface of the polishing pad PP to attach the polishing pad debris D including the magnetic material to the polishing pad PP. Accordingly, the polishing pad debris D, generated while the conditioner 30 fine-polishes the polishing pad PP, may be removed before being introduced to the polishing head 40.

The polishing head 40 may be disposed on the polishing pad PP to be spaced apart from a rear end of the magnetic module 50 with respect to one direction D1. In addition, the polishing head 40 may be disposed on a front end of the slurry supply unit with respect to the one direction D1. A semiconductor substrate W to be chemically and mechanically polished may be attached to a lower portion of the polishing head 40 by vacuum. The polishing head 40 may apply a constant polishing load to the semiconductor substrate W such that the semiconductor substrate W adheres to the polishing pad PP, and may be rotated by a disk 41 provided on the rotation shaft 42 to chemically and mechanically polish the surface of the semiconductor substrate W. In addition, according to example embodiments, the polishing head 40 may be moved in a reciprocating motion along with a rotational motion on the polishing pad PP.

The control unit 70 may be provided to control overall operation of the substrate polishing apparatus 1. The control unit 70 may be implemented as a processor such as a central processing unit (CPU), a graphics processing unit (GPU), a microprocessor, an application specific integrated circuit (ASIC), field programmable gate arrays (FPGA), or the like, and may include a memory storing various types of data required for the operation of the substrate polishing apparatus 1.

When the magnetic portion 52 of the magnetic body module 50 includes an electromagnet, the control unit 70 may control the power supply device 60, supplying power to the magnetic portion 52, to control magnetic force of the magnetic module 50. Also, the control unit 70 may control an operation of the magnetic portion 52. For example, when the polishing pad debris D needs to be removed, the control unit 70 may move the magnetic module 50 to an upper portion of the polishing pad PP, and may then control the power supply device 60 to supply power to the magnetic module 50.

Figure 6:
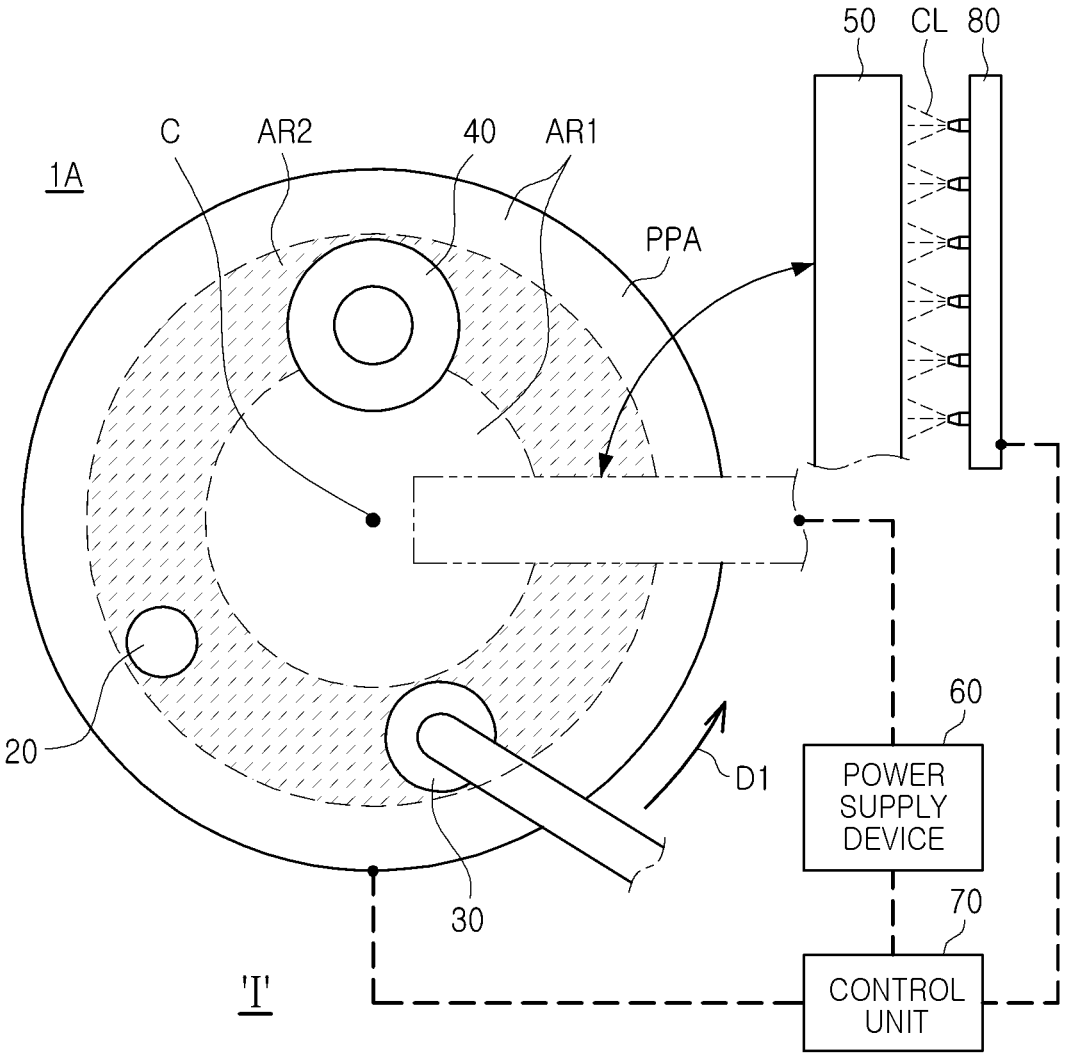
FIGS. 6 to 8 are views illustrating modified examples of the substrate polishing apparatus.
Figure 7:
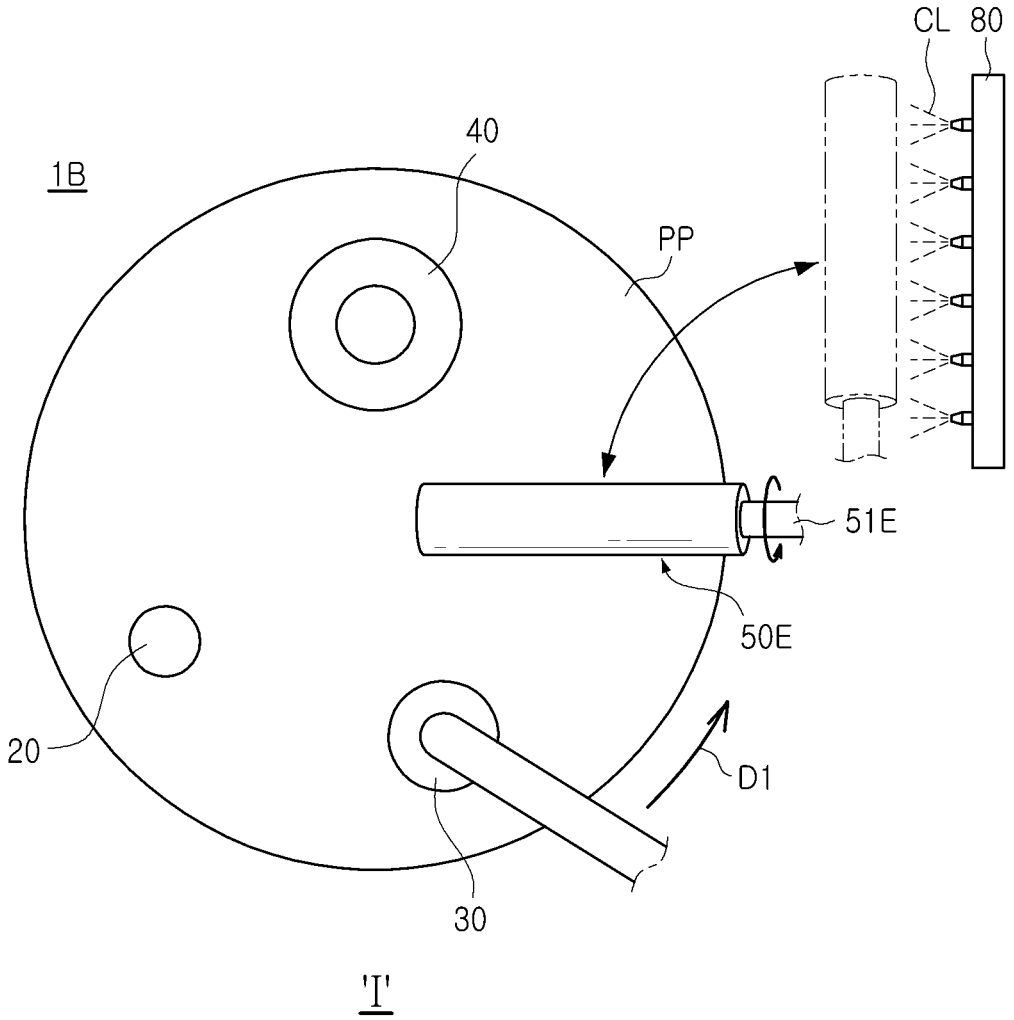
Figure 8:
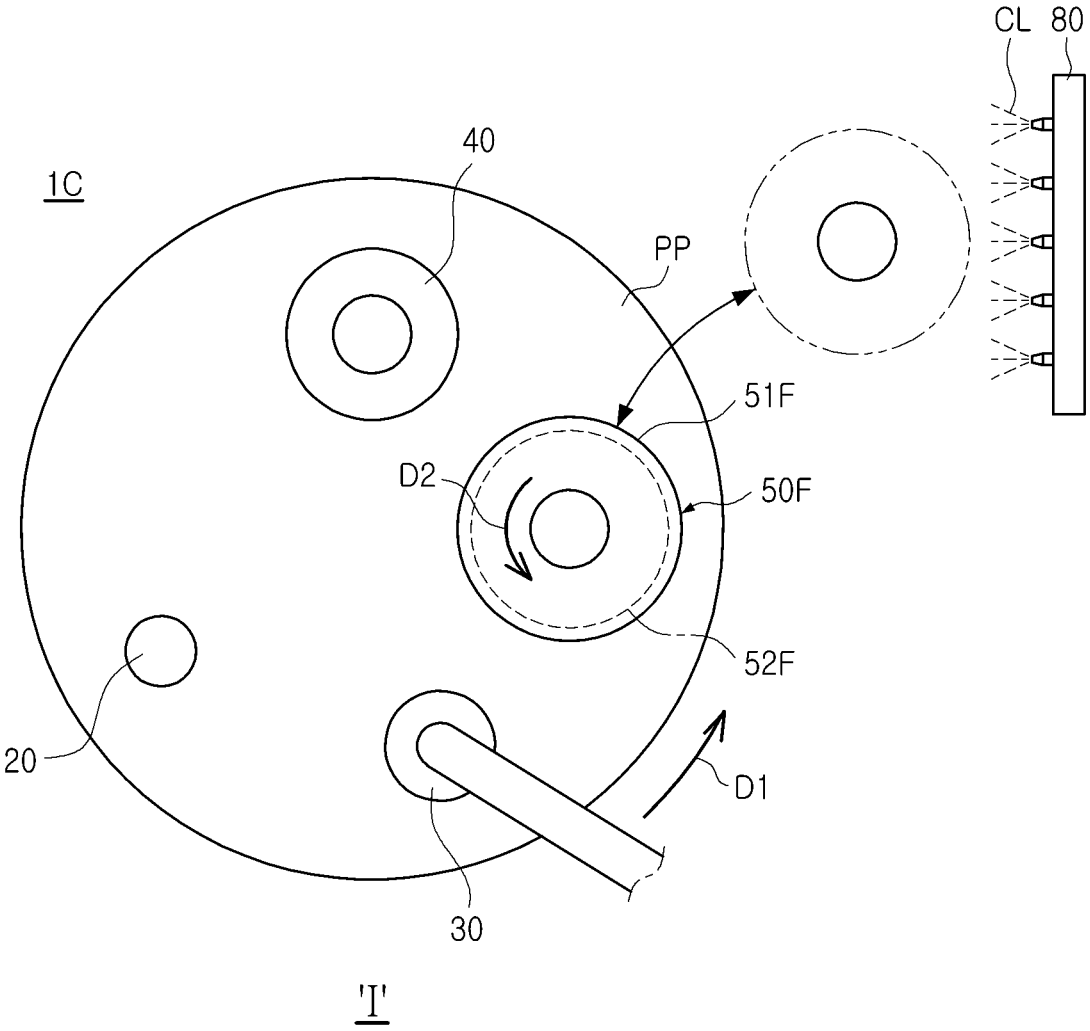

The substrate polishing apparatus 1 may be widely varied. FIGS. 6 to 8 are views illustrating modified examples of the substrate polishing apparatus.

Referring to FIG. 6, a substrate polishing apparatus 1A according to an example embodiment further includes a cleaning unit 80 cleaning a magnetic module 50, as compared with the above-described embodiment. In addition, a polishing pad PPA is divided into a first region AR1 and a second region AR2, as compared with the above-described embodiment. The other components are the same as those in the above-described embodiment, and descriptions thereof will be omitted to avoid duplication of description.

The cleaning unit 80 may be disposed in an outer portion of the polishing pad PP, and may inject cleaning liquid CL to the magnetic module 50 to clean the magnetic module 50. The cleaning unit 80 may be controlled by a control unit 70. The cleaning unit 80 may include at least one nozzle, and may inject the cleaning liquid CL to the magnetic module 50 to wash and remove polishing pad debris D and other contaminants attached to the magnetic module 50. For example, deionized water (DI water) may be used as the cleaning liquid CL.

The polishing pad PPA may include a first region AR1 and a second region AR2. The first region AR1 may be disposed in a center of the polishing pad PPA, and the second region AR2 may be disposed to have a ring shape surrounding an outer portion of the first region AR1. According to example embodiments, the first region AR1 may be disposed to surround an outer portion of the second region AR2. The first region AR1 may be formed of a magnetic material having a first magnetic property, and the second region AR2 may be formed of a material having a second magnetic property, higher than the first magnetic property. For example, the first region AR1 and the second region AR2 may be disposed to be concentric with respect to a center C of the polishing pad PP. Since the second region AR2 is subjected to relatively more conditioning performed by the conditioner 30, the amount of generated polishing pad debris D may be larger than the amount of the polishing pad debris D generated in the first region AR1. Accordingly, when second magnetic force of the second region AR2 is set to be greater than the first magnetic force of the first region AR1, the amount of the relatively large amount of the polishing pad debris D in the second region AR2 recovered in the magnetic module 50 may be increased.

Referring to FIG. 7, a substrate polishing apparatus 1B according to an example embodiment includes a magnetic module 50E having a cylindrical shape, as compared with the above-described embodiment. The other components are the same as those in the above-described embodiment, and descriptions thereof will be omitted to avoid duplication of description. The magnetic module 50E may have a rod-shaped body portion 51E, and the body portion 51E may be rotated about a rotation axis, parallel to an upper surface of a polishing pad PP.

Referring to FIG. 8, a substrate polishing apparatus 1C according to an example embodiment may include a magnetic module 50F having a disk-shaped body portion 51F and a disk-shaped magnetic portion 52F, as compared with the above-described embodiment. The magnetic portion 52F may be rotated in the same direction D2 as the one direction D1. The other components are the same as those in the above-described embodiment, and descriptions thereof will be omitted to avoid duplication of description.

Hereinafter, a method of polishing a substrate according to an example embodiment will be described. The method of polishing a substrate according to an example embodiment may be performed using the substrate polishing apparatus 1 of FIG. 1. The substrate polishing apparatus 1 of FIG. 1 has been described above, and thus detailed descriptions thereof will be omitted.

A semiconductor substrate W may be attached to a polishing head 40 of the substrate polishing apparatus 1, and may be disposed on a platen 10.

Then, the semiconductor substrate W may contact a polishing pad 11 rotating in the one direction D1.

Then, the semiconductor substrate W may be polished by supplying slurry SL onto the polishing pad 11 and rotating the polishing head 40.

Then, a conditioner 30 may be brought into contact with the polishing pad PP to condition a surface of a polishing pad PP.

Then, attractive force may be applied to a magnetic field of polishing pad debris D, generated on the surface of the polishing pad PP during a process of conditioning the polishing pad, using a magnetic module 50 spaced apart from the conditioner 30 in one direction, so that the polishing pad debris D on the surface of the polishing pad PP may be removed.

As described above, a substrate polishing apparatus and a method of polishing a substrate using the substrate polishing apparatus are provided. The substrate polishing apparatus may include a polishing pad including a magnetic material and a magnetic module applying magnetic force to polishing pad debris, generated during a conditioning process, to remove the polishing pad debris. Thus, the polishing pad debris may be readily removed.

While example embodiments have been shown and described above, it will be apparent to those skilled in the art that modifications and variations could be made without departing from the scope of the present inventive concept as defined by the appended claims.

DESCRIPTION OF REFERENCE CHARACTERS

| | |
|---|---|
| 1: Substrate Polishing Apparatus | 10: Platen |
| 20: Slurry Supply Unit | 30: Conditioner |
| 40: Polishing Head | 50: Magnetic Module |
| 60: Power Supply Device | 70: Control Unit |
| 80: Cleaning Unit | CL: Cleaning Liquid |
| SL: Slurry | W: Semiconductor Substrate |
| PP: Polishing Pad | |

What is claimed is:

1. A substrate polishing apparatus comprising:

a polishing pad including a magnetic material;

a platen having an upper surface to which the polishing pad is attached and installed to be rotatable in one direction;

a slurry supply unit installed on the polishing pad and configured to supply slurry to the polishing pad;

a conditioner installed on the polishing pad to be spaced apart from the slurry supply unit in the one direction and configured to fine-polish a surface of the polishing pad;

a polishing head installed on the polishing pad to be spaced apart from the conditioner in the one direction and configured to adhere a semiconductor substrate to the polishing pad and to rotate the adhered semiconductor substrate; and a magnetic module installed on the polishing pad to be disposed between the conditioner and the polishing head in the one direction and configured to apply magnetic force to polishing pad debris to remove the polishing pad debris, the polishing pad debris generated on the surface of the polishing pad while the surface of the polishing pad is polished.

2. The substrate polishing apparatus of claim 1, further comprising:

a cleaning unit disposed in an outer portion of the platen and configured to inject cleaning liquid to the magnetic module to clean the magnetic module.

3. The substrate polishing apparatus of claim 1, wherein the magnetic module comprises:

a body portion; and a magnetic portion disposed on a lower surface of the body portion and configured to generate the magnetic force.

4. The substrate polishing apparatus of claim 3, wherein the magnetic portion includes at least one of a permanent magnet and an electromagnet.

5. The substrate polishing apparatus of claim 3, wherein the body portion has a bar shape.

6. The substrate polishing apparatus of claim 5, wherein the magnetic portion includes a plurality of magnetic materials, and wherein the plurality of magnetic materials are disposed to be spaced apart from each other in a length direction of the body portion.

7. The substrate polishing apparatus of claim 1, wherein the magnetic module comprises:

a cylindrical body portion having a rotation shaft, parallel to the surface of the polishing pad; and a magnetic portion disposed on a side surface of the cylindrical body portion and configured to generate the magnetic force.

8. The substrate polishing apparatus of claim 1, wherein the magnetic module comprises:

a disk-shaped body portion having a rotation shaft, perpendicular to the surface of the polishing pad; and a magnetic portion disposed on a lower surface of the disk-shaped body portion and configured to generate the magnetic force.

9. The substrate polishing apparatus of claim 1, wherein the magnetic material includes at least one of a magnetic polymer and a magnetic particle.

10. The substrate polishing apparatus of claim 9, wherein the magnetic polymer includes a polymer PANICNQ, a combination of emeraldine-based polyaniline (PANi) and tetracyanoquinodimethane (TCNQ).

11. The substrate polishing apparatus of claim 9, wherein the magnetic particle includes at least one of $FE_3O_4$ and $CoFe_2O_4$.

12. The substrate polishing apparatus of claim 1, wherein the polishing pad comprises:

a first region disposed in a center of the polishing pad and having a first magnetic property; and a second region disposed in the form of a ring having a predetermined width to surround the first region and having a second magnetic property, greater than the first magnetic property.

13. A substrate polishing apparatus comprising:

a platen having an upper surface, to which a polishing pad including a magnetic material is attached, and installed to be rotatable in one direction;

a conditioner installed on the polishing pad and configured to modify surface roughness of the polishing pad;

a magnetic module installed on the polishing pad to be spaced apart from the conditioner in the one direction and including an electromagnet applying magnetic force to polishing pad debris, the polishing pad debris generated on the a surface of the polishing pad while the surface of the polishing pad is fine-polished;

a power supply device configured to supply power for generating the magnetic force to the electromagnet of the magnetic module on the polishing pad; and a control unit configured to control the power supply device to control an operation of the magnetic module.

14. The substrate polishing apparatus of claim 13, further comprising:

a cleaning unit disposed in an outer portion of the platen and configured to inject cleaning liquid to the magnetic module to clean the magnetic module.

15. The substrate polishing apparatus of claim 14, wherein the control unit cuts off the power while the cleaning unit injects the cleaning liquid to the magnetic module.

16. The substrate polishing apparatus of claim 13, wherein the polishing pad debris is attached to the magnetic module by the magnetic force when the power is supplied to the magnetic module.

17. A substrate polishing apparatus comprising:

a polishing pad including a magnetic material;

a platen having a surface, to which a-the polishing pad including & the magnetic material is attached, and installed to be rotatable in one direction;

a conditioner installed on the polishing pad and configured to condition a surface of the polishing pad; and a magnetic module installed on the polishing pad to be spaced apart from the conditioner in the one direction and configured to apply attractive force generated by a magnetic field to polishing pad debris to remove the polishing pad debris from the surface of the polishing pad, the polishing pad debris generated on the surface of the polishing pad while the conditioner conditions the surface of the polishing pad . . .

18. The substrate polishing apparatus of claim 17, wherein the magnetic module includes an electromagnet.

19. The substrate polishing apparatus of claim 18, comprising:

a power supply device configured to supply power for generating the magnetic field to the electromagnet of the magnetic module; and a control unit configured to control the power supply device to control an operation of the magnetic module.

20. The substrate polishing apparatus of claim 17, wherein the magnetic module incudes a permanent magnet, and wherein the permanent magnet is a neodymium magnet.

* * * * *